US005678536A

United States Patent [19]

Martin

[11] Patent Number: 5,678,536

[45] Date of Patent: Oct. 21, 1997

[54] LIQUID AIR MIXING SYSTEM

[75] Inventor: Robert B. Martin, Mims, Fla.

[73] Assignee: The United States of America as represented by the Administrator of the National Aeronautics and Space Administration, Washington, D.C.

[21] Appl. No.: 528,632

[22] Filed: Sep. 5, 1995

[51] Int. Cl.[6] ..... A62B 7/06

[52] U.S. Cl. ..... 128/201.21; 128/202.26

[58] Field of Search ..... 128/201.21, 201.27, 128/201.28, 201.11, 202.26

[56] References Cited

U.S. PATENT DOCUMENTS

| | | | |
|---|---|---|---|
| 1,472,117 | 10/1923 | Drager . | |
| 3,318,307 | 5/1967 | Nicastro | 128/201.21 |
| 3,366,107 | 1/1968 | Frantom . | |
| 3,368,556 | 2/1968 | Jensen et al. . | |
| 3,807,396 | 4/1974 | Fischel . | |
| 3,941,124 | 3/1976 | Rodewald et al. . | |
| 4,072,148 | 2/1978 | Munson et al. . | |
| 4,181,126 | 1/1980 | Hendry | 128/201.21 |
| 4,206,753 | 6/1980 | Fife | 128/201.21 |
| 4,425,811 | 1/1984 | Chatzipetros et al. . | |
| 4,852,563 | 8/1989 | Gross . | |

OTHER PUBLICATIONS

Skin Diver, Jun. 1967, "I Dived on Liquid Air", by Paul J. Tzimoulis.

*Primary Examiner*—Aaron J. Lewis

*Attorney, Agent, or Firm*—Beth A. Vrioni; John G. Mannix

[57] ABSTRACT

A device for mixing liquid nitrogen and liquid oxygen to form liquid air. The mixing device consists of a tube for transferring liquid oxygen positioned within a tube for transferring liquid nitrogen. Supply vessels for liquid oxygen and liquid nitrogen are equally pressurized and connected to the appropriate tubes. Liquid oxygen and nitrogen flow from the supply vessels through the respective tubes and are mixed to form liquid air upon exiting the outlets of the tube. The resulting liquid air is transferred to a holding vessel.

18 Claims, 2 Drawing Sheets

LIQUID AIR MIXING SYSTEM

ORIGIN OF THE INVENTION

The invention described herein was made in the performance of work under a National Aeronautics and Space Administration ("NASA") contract and is subject to the provisions of Section 305 of the National Aeronautics and Space Act of 195, Public Law 85-568 (72 Stat. 435; 42 U.S.C. 2457).

BACKGROUND OF THE INVENTION

The present invention relates to a liquid air mixing system which can mix liquid nitrogen and liquid oxygen to produce liquid air. NASA has developed a self-contained breathing apparatus for fire rescue and launch pad close out which uses liquid air rather than the conventional compressed gaseous air. A major obstacle to the commercial development of an air breathing apparatus using liquid air is the lack of an economical and practical means for supplying liquid air.

It is important that the air used in breathing equipment has a 20 to 30% oxygen concentration. Breathing air with oxygen in too high of concentrations may result in oxygen poisoning and an oxygen deficiency may produce hypoxia, causing fatigue or death. A number of techniques have been employed to mix gaseous oxygen and nitrogen to form gaseous air, but these techniques are not applicable for mixing liquid air.

Previously, liquid air was made by pumping compressed gaseous air through coils submersed in liquid nitrogen. This method takes considerable time and requires specification breathing air to produce liquid air for breathing equipment. Another method used to prepare liquid air included transferring liquid oxygen and liquid nitrogen to a tank and circulating the liquids until mixed. The liquid air prepared with the above method may experience stratification, causing the oxygen and nitrogen to separate. In addition, NASA developed a method of mixing liquid air in large quantities, normally 600 gallons or more. However, most users do not require such great quantities and liquid air is wasted if stored over time because of oxygen enrichment, resulting in liquid air with an oxygen concentration exceeding 30%.

SUMMARY OF THE INVENTION

The present invention is intended to fulfill the above identified need by providing a system and method to produce liquid air.

The preferred embodiment of the invention includes a tube for liquid oxygen positioned inside a tube for liquid nitrogen. Liquid oxygen and liquid nitrogen are supplied from pressurized vessels to the appropriate tubes. In the preferred embodiment of the invention the vessels are maintained at equal pressures and the liquid nitrogen and oxygen are conditioned so that the saturation pressures are at one atmosphere. The configuration of the mixing device allows subcooling of the oxygen before it mixes with the liquid nitrogen.

An advantage of the present invention is that it is a simple mixing system that produces liquid air in a short time. Using the preferred embodiment a 165 liter dewar of liquid air can be produced in approximately 5 to 10 minutes. Also, the liquid air mixed using the present invention does not experience stratification.

BRIEF DESCRIPTION OF THE DRAWINGS

The following is a description of a preferred embodiment of the present invention.

DETAILED DESCRIPTION OF THE PREFERRED EMBODIMENT

Figure 1:
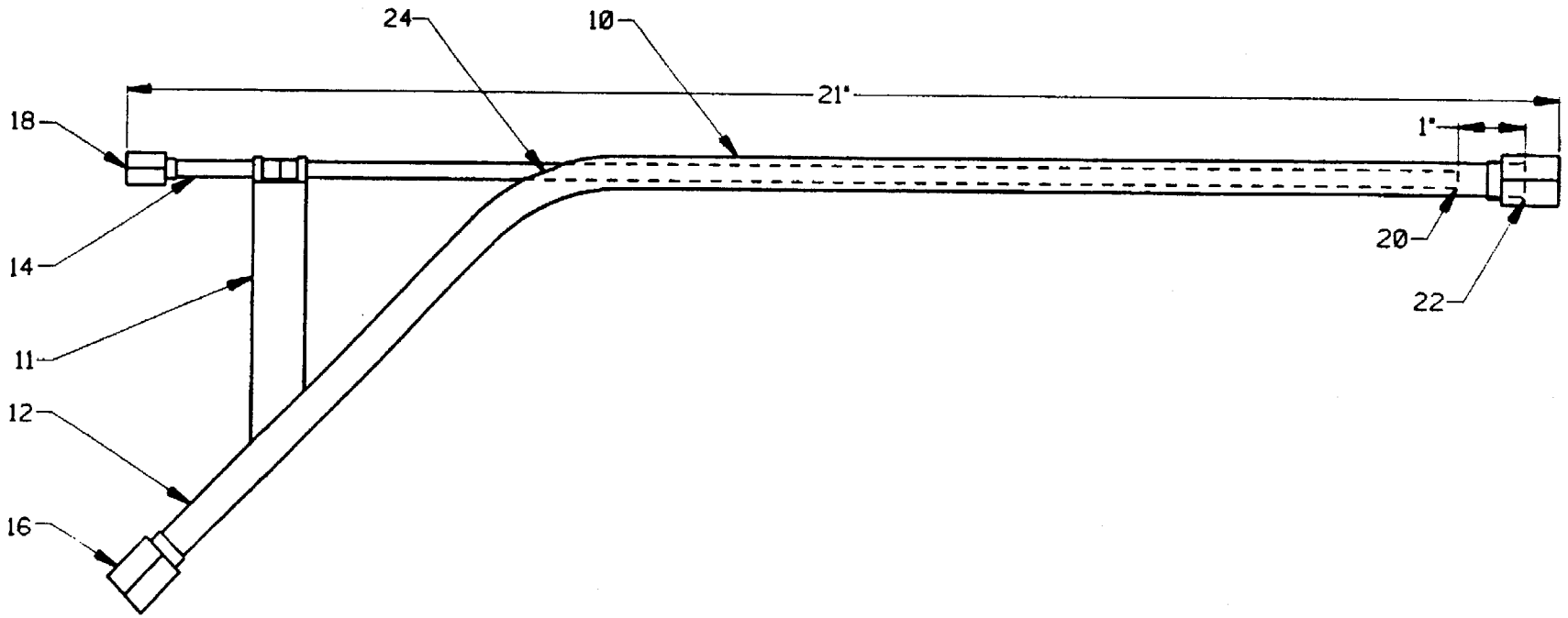
FIG. 1 is a schematic illustration of a mixing device.

FIG. 1 illustrates the mixing device 10 for mixing liquid oxygen and liquid nitrogen to form liquid air with a 20 to 30% concentration of oxygen. The device consists of a ½ inch tube 12 for transferring liquid nitrogen having an inlet 16 and an outlet 22, and a ¼ inch tube 14 for transferring liquid oxygen having an inlet 18 and an outlet 20. In the preferred embodiment the tubes 12, 14 are made of stainless steel with a wall thickness of 0.049 inch. Also, the nitrogen tube 12 is bent at a 45 degree angle and has an opening 24 for the oxygen tube 14. A brace 11 holds the oxygen tube 14 in the center of the nitrogen tube 12 with the outlet of the nitrogen tube 22 extending beyond the oxygen tube outlet 20. The configuration of the mixing device 10 allows subcooling of the oxygen prior to mixing with the liquid nitrogen. Note that other tube sizes and angles may be used, the preferred embodiment is merely an example of one configuration.

Figure 2:
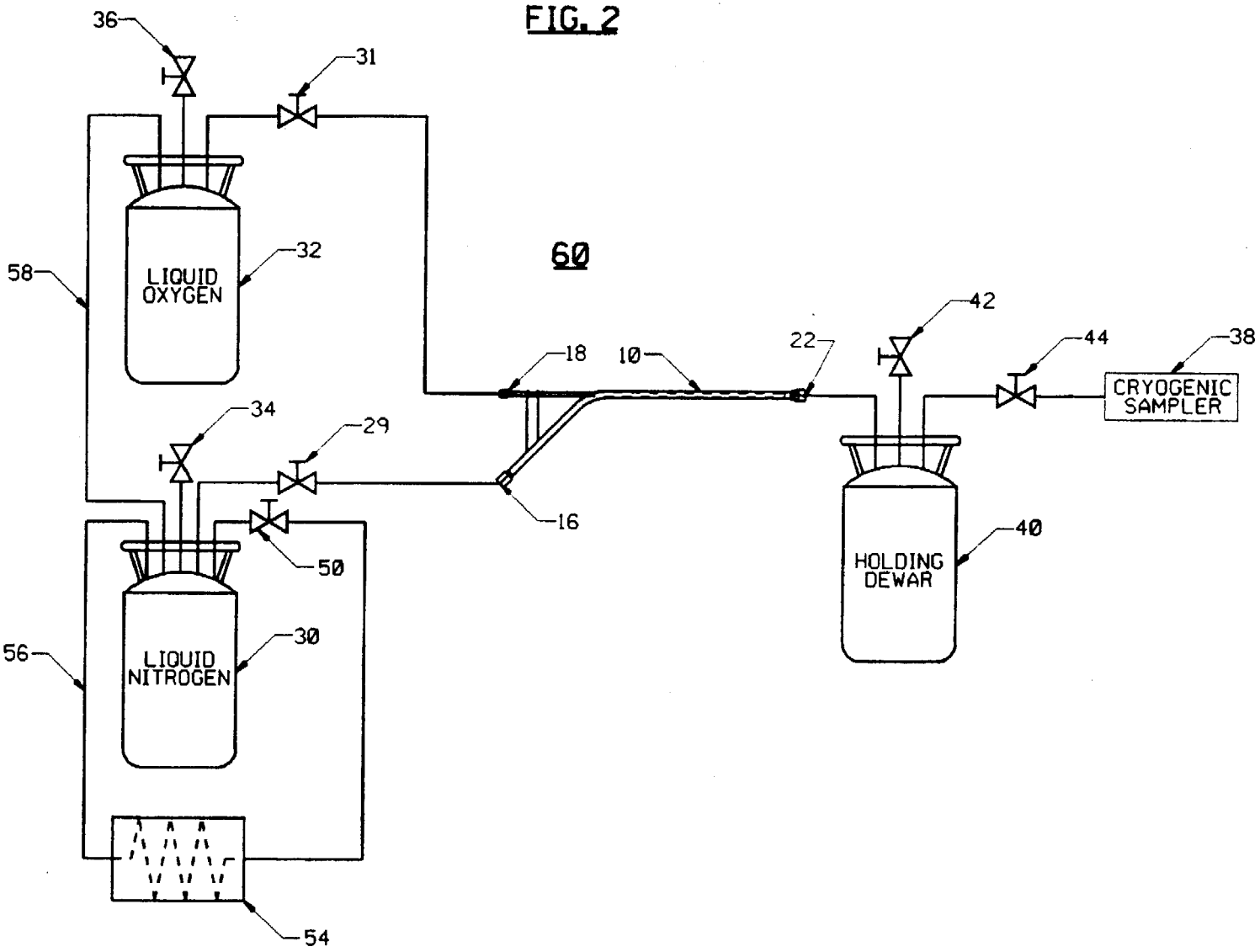
FIG. 2 is a schematic diagram of a liquid air mixing system.

FIG. 2 illustrates the liquid air mixing system 60 This system consists of a first supply vessel of liquid nitrogen 30 with a nitrogen vent valve 34 and a second supply vessel of liquid oxygen 32 with an oxygen vent valve 36. In the preferred embodiment the nitrogen supply vessel 30 is a 600 liter dewar and the oxygen supply vessel 32 is a 180 liter dewar. Liquid nitrogen is transferred from the nitrogen supply vessel to the inlet of the ½ inch tube 16 through a nitrogen supply valve 29. Liquid oxygen is transferred from the oxygen supply vessel 32 to the inlet of the ¼ inch tube 18 through an oxygen supply valve 31. The nitrogen tube outlet 22 is flared and connected to a holding vessel 40 for the mixed liquid air. The holding vessel 40 in the preferred embodiment is a 165 liter dewar and has an air vent valve 42. A cryogenic sampler 38 may be connected to the holding dewar 40 through an air supply valve 44 to determine the percentage of oxygen in the mixed liquid air. An example of a cryogenic sampler is the Cosmodyne model CS -4.4, type TTU-131/E.

In the preferred embodiment the nitrogen dewar 30 is self pressurized. A third valve 50 is connected to the nitrogen supply vessel 30 and allows liquid nitrogen to transfer to a heat exchanger coil 54. Gaseous nitrogen exits the heat exchanger coil 54, flows through a nitrogen line 56 and into the nitrogen vessel 30. In addition, a second line 58 connects the nitrogen supply vessel and the oxygen supply vessel. The gaseous nitrogen flows through the second line 58 to the oxygen vessel 32, maintaining an equal pressure in both supply vessels 32, 30.

In the operation of the liquid air mixing system 60, the liquid nitrogen and oxygen vessels 30, 32 are conditioned to an equal saturation pressure of one atmosphere. The conditioning can be accomplished by opening for a minimum of 24 hours the nitrogen vent valve 34 and the oxygen vent valve 36. In addition, the supply vessels 30, 32 are equally pressurized, preferably to between 60 and 70 psig, by adjusting the third nitrogen valve 50. After the supply vessels 30, 32 are pressurized the nitrogen and oxygen supply valves 31, 33 should be opened simultaneously, allowing the oxygen and nitrogen to flow to the respective inlets of the tubes 16, 18. The liquid oxygen and nitrogen continue to flow through the mixing device 10 and are mixed at the oxygen tube outlet 20, the resulting liquid air flows into the holding vessel 40.

Although the invention is disclosed in terms of a preferred embodiment, there are numerous variations and modifications that could be made thereto without departing from the invention as set forth in the following claims

What is claimed is:

1. A system for mixing liquid oxygen and liquid nitrogen to form liquid air with a breathable percentage of oxygen comprising:

a first tube for transferring liquid oxygen having an inlet and an outlet;

a second tube for transferring liquid nitrogen having an inlet and an outlet, the second tube being joined to the first tube;

a means for supplying liquid oxygen to the inlet of the first tube;

a means for supplying liquid nitrogen to the inlet of the second tube;

a means for injecting the liquid oxygen into the second tube with the liquid nitrogen, Whereby the liquids are mixed forming liquid air; and a holding vessel connected to the outlet of the second tube for holding the liquid air.

2. The system of claim 1 wherein the second tube has an opening and the first tube fits through the opening with the outlet of the first tube located inside the second tube, whereby the liquid oxygen and liquid nitrogen are mixed near the outlet of the first tube.

3. The system of claim 1 wherein:

the means for supplying liquid oxygen to the inlet of the first tube comprises a liquid oxygen supply vessel connected to the inlet of the first tube and an oxygen supply valve located between the oxygen supply vessel and the first tube inlet.

4. The system of claim 3 wherein:

the means for supplying liquid nitrogen to the inlet of the second tube comprises a liquid nitrogen supply vessel connected to the inlet of the second tube and a nitrogen supply valve located between the nitrogen supply vessel and the second tube inlet.

5. The system of claim 4 further comprising a means for pressurizing both the oxygen supply vessel and the nitrogen supply vessel.

6. The system of claim 5 wherein the means for pressurizing the oxygen and nitrogen supply vessel comprises:

a heat exchanger coil connected to the nitrogen supply vessel, whereby the liquid nitrogen flows from the nitrogen supply vessel through the heat exchanger coil to form gaseous nitrogen that flows to the nitrogen supply vessel; and a valve located between the nitrogen supply vessel and the heat exchanger coil for controlling the amount of liquid nitrogen exiting the nitrogen vessel; and a tube connected to the nitrogen supply vessel and the oxygen supply vessel, allowing gaseous nitrogen to flow from the nitrogen supply vessel to the oxygen supply vessel, maintaining equal pressures in both vessels.

7. The system of claim 1 wherein:

the means for supplying liquid nitrogen to the inlet of the second tube comprises a liquid nitrogen supply vessel connected to the inlet of the second tube and a nitrogen supply valve located between the nitrogen supply vessel and the second tube inlet.

8. The apparatus of claim 1 wherein the liquid air has a percentage of oxygen between 20 to 30 percent.

9. A method for mixing liquid air comprising the steps:

providing a first supply vessel of liquid nitrogen and a second supply vessel of liquid oxygen;

transferring the liquid nitrogen from the first supply vessel to a first tube and the liquid oxygen from the second supply vessel to a second tube;

injecting the liquid oxygen into the first tube with the liquid nitrogen, whereby the liquids are mixed to form liquid air; and transferring the liquid air from the first tube to a holding vessel.

10. The method of claim 9 wherein the step of providing a supply vessel of liquid oxygen and a supply vessel of liquid nitrogen comprises conditioning the liquid oxygen and liquid nitrogen to equal saturation pressures.

11. The method of claim 10 wherein the liquid oxygen and liquid nitrogen are conditioned to a saturation pressure of one atmosphere.

12. The method of claim 9 wherein the supply vessels are pressurized in the range of 60 to 70 psig.

13. The method of claim 9 further comprising the step of equally pressurizing the first and second supply vessels prior to said step of transferring the liquids to the tubes.

14. A method for forming liquid air with a breathable percentage of oxygen comprising the steps:

providing a first supply vessel of a carrier liquid and a second supply vessel of liquid oxygen;

transferring the liquid nitrogen from the first supply vessel to a first tube and the liquid oxygen from the second supply vessel to a second tube;

injecting the liquid oxygen into the first tube with the carrier liquid, whereby the liquids are mixed to form liquid air; and transferring the liquid air from the second tube to a holding vessel.

15. The method of claim 14 wherein the step of providing the supply vessel of liquid oxygen and the supply vessel of the carrier liquid nitrogen comprises conditioning the liquid oxygen and carrier liquid to equal saturation pressures.

16. The method of claim 14 further comprising the step of equally pressurizing the first and second supply vessels prior to said step of transferring the liquids to the tubes.

17. The method of claim 14 further comprising the step of measuring the percentage of oxygen in the liquid air.

18. The method of claim 14 wherein the liquid air has a percentage of oxygen between 20 to 30 percent.

* * * * *